United States Patent [19]

Saxton

[11] Patent Number: 5,048,184

[45] Date of Patent: Sep. 17, 1991

[54] SLOT BLADE HOLDER

[76] Inventor: Clarence E. Saxton, 4522 Orchard Ave., San Diego, Calif. 19107

[21] Appl. No.: 611,840

[22] Filed: Nov. 13, 1990

[51] Int. Cl.[5] ..... B26B 3/00

[52] U.S. Cl. ..... 30/169; 30/334; 30/339

[58] Field of Search ..... 30/164, 329, 334, 337, 30/339; 15/236.1

[56] References Cited

U.S. PATENT DOCUMENTS 2,610,401 9/1952 Vosbikian et al. ..... 30/169

*Primary Examiner*—Douglas D. Watts

*Attorney, Agent, or Firm*—Michael I. Kroll

[57] ABSTRACT

A slot blade holder is provided and consists of a mechanism for securing the rear flange of a standard single edge razor blade at its central aperture transversely within a slot in the forward flattened end of a handle, so that the front cutting edge of the razor blade is in a position to remove various materials from flat surfaces and cut materials when used in conjunction with a straight edge.

6 Claims, 1 Drawing Sheet

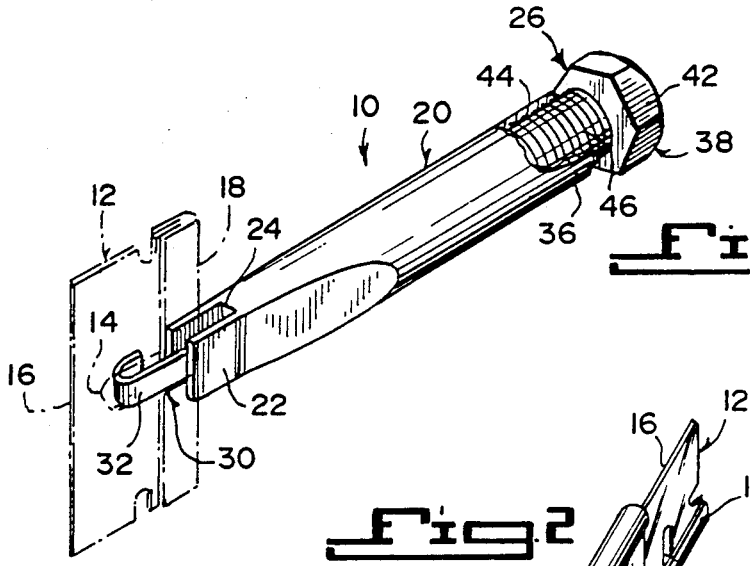
Fig. 1
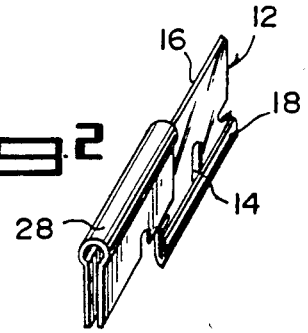
Fig. 2
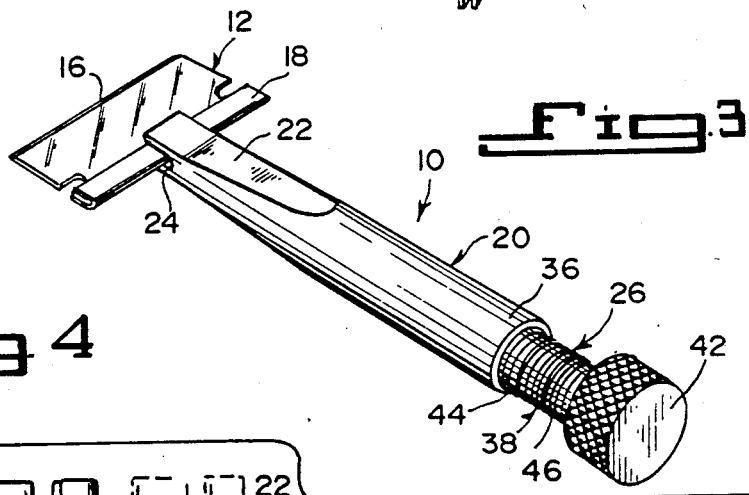
Fig. 3
Fig. 4
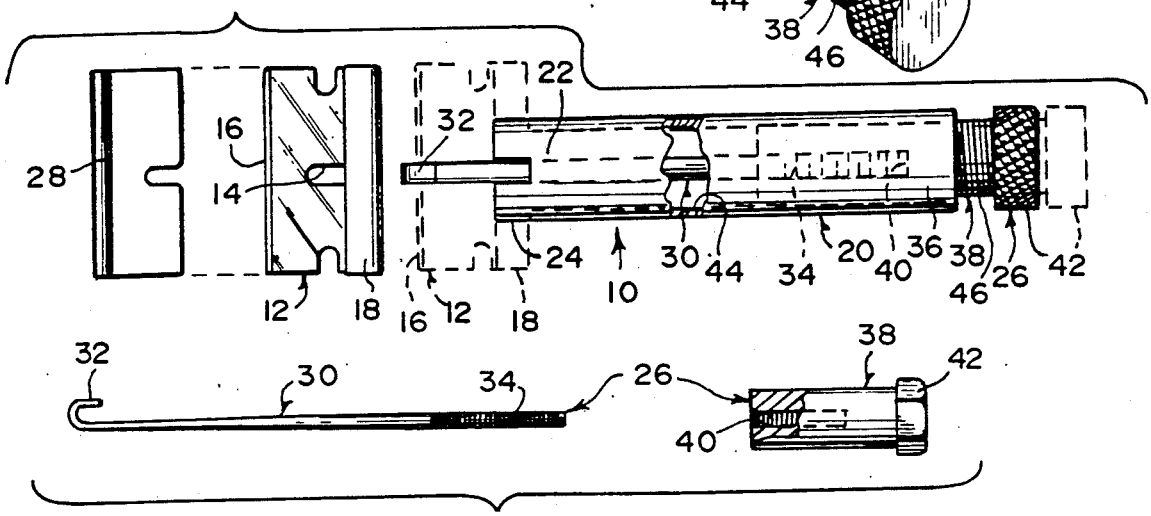
Fig. 5

SLOT BLADE HOLDER

BACKGROUND OF THE INVENTION

1. Field of the Invention

The instant invention relates generally to scraper tools and more specifically it relates to a slot blade holder.

2. Description of the Prior Art

Numerous scraper tools have been provided in prior art that are adapted to remove paint and the like from various surfaces. While these units may be suitable for the particular purpose to which they address, they would not be as suitable for the purposes of the present invention as heretofore described.

SUMMARY OF THE INVENTION

A primary object of the present invention is to provide a slot blade holder that will overcome the shortcomings of the prior art devices.

Another object is to provide a slot blade holder that will transversely secure a single edge razor blade to a handle so that the holder can be used in removing various materials from flat surfaces.

An additional object is to provide a slot blade holder that can be utilized as a cutting tool for paper, cardboard, fabric and light plastic when used in conjunction with a straight edge or the like.

A further object is to provide a slot blade holder that is simple and easy to use.

A still further object is to provide a slot blade holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front perspective view of the instant invention with the razor blade in phantom and the handle broken away.

FIG. 2 is a perspective view of a safety shield being slid onto the cutting edge of the razor blade.

FIG. 3 is a rear perspective view of a modification in which a round knurled head is on the threaded shaft to turn the shaft.

FIG. 4 is a top plan view of the modification shown in FIG. 3 with the razor blade and safety shield exploded therefrom.

FIG. 5 is a side view of the rod member and another modification showing a plain shaft with the hex head knob.

DETAILED DESCRIPTION OF THE PREFERRED EMBODIMENTS

Turning now descriptively to the drawings, in which similar reference characters denote similar elements throughout the several views, the Figures illustrate a slot blade holder 10 for a standard single edge razor blade 12 having a central aperture 14, a front cutting edge 16 and a rear flange 18. The holder 10 consists of a hollow tubular handle 20 having its forward end 22 flattened with a slot 24 therethrough to receive transversely the rear flange 18 of the razor blade 12. A mechanism 26 is for securing the rear flange 18 of the razor blade 12 at the central aperture 14 within the slot of the forward end 22 of the handle 20. The front cutting edge 16 of the razor blade 12 is in a position to remove various materials from flat surfaces and cut materials when used in conjunction with a straight edge or the like.

A safety shield 28 slides over the cutting edge 16 of the razor blade 12 to cover the cutting edge when the holder 10 is not being used and is placed in storage.

The securing mechanism includes a rod 30 having a hooked end 32 and a threaded end 34. The rod 30 fits into the rearward end 36 of the handle 20 so that the hooked end 32 can engage with the central aperture 14 of the razor blade 12. A shaft 38 is provided having a threaded bore 40 in one end ad an enlarged head 42 at the other end. The shaft 38 extends into the rearward end 36 of the handle 12, so that the threaded end 34 of the rod 30 can enter the threaded bore 46 and the head 42 be rotated to tighten the hooked end 32 within the central aperture 14 of the razor blade 12.

As shown in FIGS. 1, 3 and 4, the rearward end 36 of the handle 20 has internal threads 44. The shaft 38 has external threads 46 which engage with the integral threads 44 in the rearward end 36 of the handle 20. In FIGS. 1 and 5 the head 42 is hex shaped so it can be gripped and turned by hand. The head 42, as shown in FIGS. 3 and 4, can also be round shaped and knurled so it can be gripped and turned by hand.

To use the holder 10, the following steps must be taken:

1. Slide the safety shield 28 onto the cutting edge 16 of the razor blade 12.
2. Loosen the head 42 on the shaft 38 so that the hooked end 32 of the rod 30 can engage with the central aperture 14 in the razor blade 12.
3. Push the safety shield 28 and razor blade 12 with the hooked end 32 in the central aperture 14 into the slot 24 in the handle 20.
4. Tighten the head 42 on the shaft 38 so that the hooked end 32 on the rod 30 will firmly hold the razor blade 12 in its proper position.

LIST OF REFERENCE NUMBERS

10 slot blade holder
12 standard single edge razor blade
14 central aperture in 12
16 front cutting edge on 12
18 rear flange on 12
20 hollow tubular handle
22 flattened forward end of 20
24 slot in 22
26 securing mechanism
28 safety shield for 12
30 rod
32 hooked end on 30
34 threaded end on 30
36 rearward end of 20
38 shaft
40 threaded bore in 38
42 enlarged head on 38
44 internal threads in 36
46 external threads on 38

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A slot blade holder for a standard single edge razor blade having a central aperture, a front cutting edge and a rear flange, said holder comprising:

a) a hollow tubular handle having its forward end flattened with a slot therethrough to receive transversely the rear flange of the razor blade; and b) means for securing the rear flange of the razor blade at the central aperture within the slot of the forward end of said handle, so that the front cutting edge of the razor blade is in a position to remove various materials from flat surfaces and cut materials when used in conjunction with a straight edge or the like, c) a safety shield which slides over the cutting edge of the razor blade to cover the cutting edge when said holder is not being used and placed in storage.

2. A slot blade holder as recited in claim 1, wherein said securing means includes:

a) a rod having a hooked end and a threaded end, whereby said rod fits into the rearward end of said handle so that the hooked end can engage with the central aperture of the razor blade; and b) a shaft having a threaded bore in one end and an enlarged head at the other end, whereby said shaft extends into the rearward end of said handle, so that the threaded end of said rod can enter the threaded bore and the head be rotated to tighten the hooked end within the central aperture of the razor blade.

3. A slot blade holder as recited in claim 2, further including:

a) the rearward end of said handle having internal threads; and b) said shaft having external threads which engage with the internal threads in the rearward end of said handle.

4. A slot blade holder as recited in claim 3, wherein the head on said shaft is hex shaped so it can be gripped and turned by hand.

5. A slot blade holder as recited in claim 3, wherein the head on said shaft is round shaped and knurled so it can be gripped and turned by hand.

6. A slot blade holder as recited in claim 2, wherein the head on said shaft is hex shaped so it can be gripped and turned by hand.

* * * * *